US005787524A

United States Patent [19]

Butnik

[11] Patent Number: 5,787,524

[45] Date of Patent: Aug. 4, 1998

[54] CRIB FOR MORE THAN ONE INFANT

[76] Inventor: Robert A. Butnik, 90 Linda Isle, Newport Beach, Calif. 92660

[21] Appl. No.: 881,426

[22] Filed: Jun. 24, 1997

[51] Int. Cl.[6] ..... A47D 7/00; A47D 13/06

[52] U.S. Cl. ..... 5/93.1; D6/390

[58] Field of Search ..... 5/93.1–100, 513; D6/390, 391

[56] References Cited

U.S. PATENT DOCUMENTS

| | | | |
|---|---|---|---|
| D. 378,789 | 4/1997 | Morris | D6/390 |
| 2,471,691 | 5/1949 | Hurst | 5/93.1 |
| 2,686,922 | 8/1954 | La Vigne | 5/93.1 |
| 2,851,700 | 9/1958 | Denison | 5/93.1 |
| 3,084,351 | 4/1963 | Kulp et al. | 5/2.1 |
| 3,610,716 | 10/1971 | Weinberg | 5/93.1 |
| 4,232,411 | 11/1980 | Speyer | 5/8 |
| 4,890,346 | 1/1990 | Rist | 5/513 |
| 5,572,751 | 11/1996 | Brandt | 5/9.1 |
| 5,706,533 | 1/1998 | Opheim et al. | 5/93.1 |

FOREIGN PATENT DOCUMENTS

| | | | |
|---|---|---|---|
| 2113987 | 8/1983 | United Kingdom | 5/513 |

OTHER PUBLICATIONS

"Twins", A 1989 Pamphlet Related to U.S. Patent 4,890,346.

*Primary Examiner*—Alexander Grosz
*Attorney, Agent, or Firm*—Lyon & Lyon LLP

[57] ABSTRACT

A crib for more than one infant has multiple sleeping areas. In a first embodiment, there are two sleeping areas separated by a clear plexiglass divider. In another embodiment, there are three sleeping areas separated by clear plexiglass dividers. Front panels of the sleeping areas are adjustable to two different heights.

27 Claims, 4 Drawing Sheets

CRIB FOR MORE THAN ONE INFANT

FIELD OF THE INVENTION

The present invention relates to infant furniture, and more particularly to cribs.

BACKGROUND OF THE INVENTION

Cribs for infants exist in many styles, and have been available for many years. Traditionally a crib is used for a single infant, and includes an adjustable bottom and four sides, as well as four legs to support the bottom and sides. The bottom in turn supports a mattress which the infant rests upon, and the sides prevent the infant from falling out of the crib. It is also common for at least one of the sides to contain a plurality of vertical safety bars with empty space therebetween, the distance between the bars being small enough so the infant's head cannot wedge in between them, but large enough for the infant to see outside of the crib.

Modern cribs have also included various amenities such as drawers built in below the mattress area or shelves attached to the end of the crib, so extra sheets, baby clothes, and diaper-changing materials may be kept close by. It is also common for modern cribs to have a mechanism for adjusting the height of the crib sides and the bottom. Thus, a side can be lowered to allow a caretaker easy access to the infant, and the bottom can be lowered as needed to assure the mattress is at a height safe enough that the infant will not fall out of the crib despite growing taller and stronger. Caretakers with more than one infant, e.g. twins or triplets, are required to have one crib for each infant. This leads to additional expenses, and usually requires twice the physical space as compared to a single crib. There may not be enough room to position all of the cribs next to each other, or even in the same room, and so it might also be difficult for a caretaker to maintain a suitable watch on all of the infants. Also, placing the infants in separate cribs, even if the cribs are nearby, isolates the infants from each other, preventing them from interacting. But there is generally not enough room to place more than one infant in a single crib, after they are a few months old. And even if there was enough room, it would be undesirable to do so because the infants could potentially injure each other either intentionally or accidentally. Moreover, one infant could disturb another infant's sleep by jostling into the other infant.

SUMMARY OF THE INVENTION

An object of this invention is to provide an improved crib for infants. Another object is to provide a crib capable of supporting and containing more than one infant at the same time. Another object is to provide a crib that allows the multiple infants to see each other and remain close to each other.

In a preferred embodiment of the present invention, the above objects are accomplished by a twin crib designed to hold two infants, typically twins. The crib has two sleeping areas separated by a clear plexiglass divider. Front panels of the sleeping areas are adjustable to two heights and intersect preferably at an angle of approximately ninety degrees. Side support panels connect the front panels to corresponding back panels which preferably run parallel to the corresponding front panels. The back panels are separated from each other by a center support panel prior to intersecting, each back panel intersecting the center support panel at an angle of approximately one-hundred and thirty-five degrees. The panels are connected together to form the outer boundaries of the twin crib.

The center support panel is preferably to be positioned in the corner of a room, with the two back panels extending along the intersecting walls which form the corner. Thus, the twin crib can be placed in the corner of a room and occupy less space than if two separate cribs were utilized. Additionally, two infants in the crib can see each other through the plexiglass divider, enabling them to interact. For twins, this furthers the bond which began in utero. The infants will be close enough to each other for a caretaker to monitor them simultaneously, but they will still be physically separated from each other and unable to cause each other any harm.

In another preferred embodiment of the present invention, the above objects are accomplished by a triplet crib designed to hold three infants. The crib has three sleeping areas separated by clear plexiglass dividers. The front panels of the sleeping areas are adjustable to two heights and intersect at approximately right angles to form three sides of a square. The fourth side of the square remains open, and the inside of the square serves as a standing area outside of the crib where the caretaker has access to all three front panels. Other panels are connected to the three front panels and then to additional panels, which together form the outer boundaries of the triplet crib.

Other advantages of this invention will become apparent from the detailed description of the preferred embodiments which follow, when read in conjunction with the accompanying drawings.

DETAILED DESCRIPTION

Figure 1:
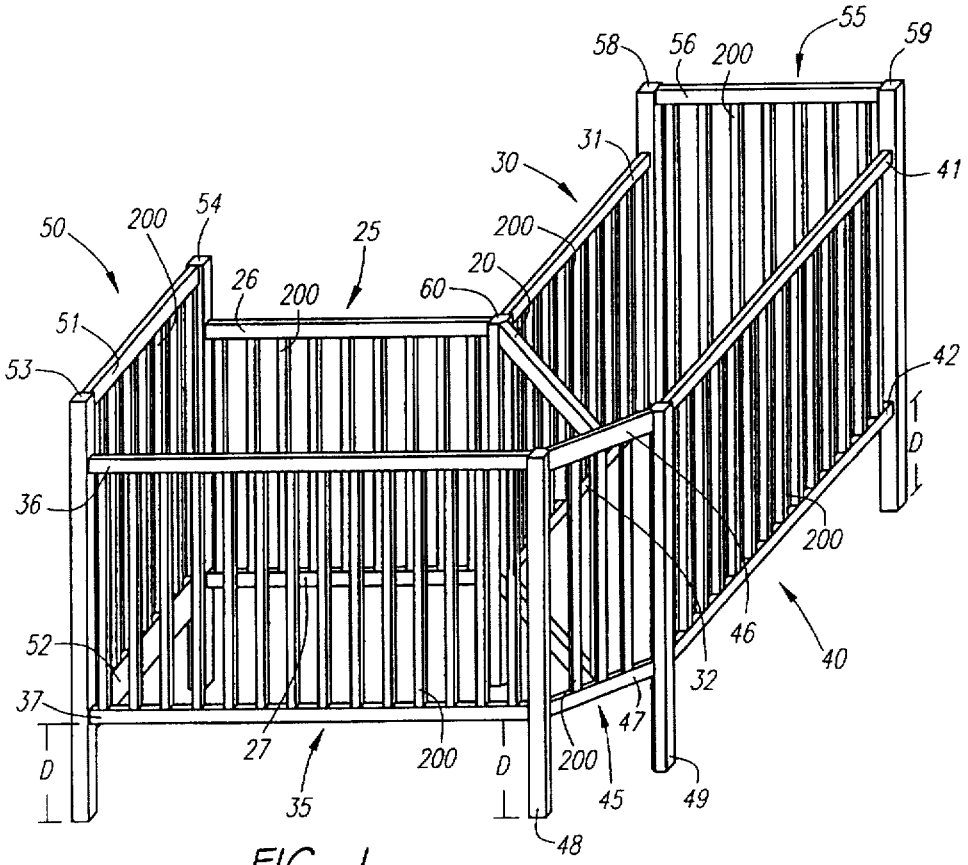
FIG. 1 is a perspective view from the back of the twin crib of the present invention.
Figure 2:
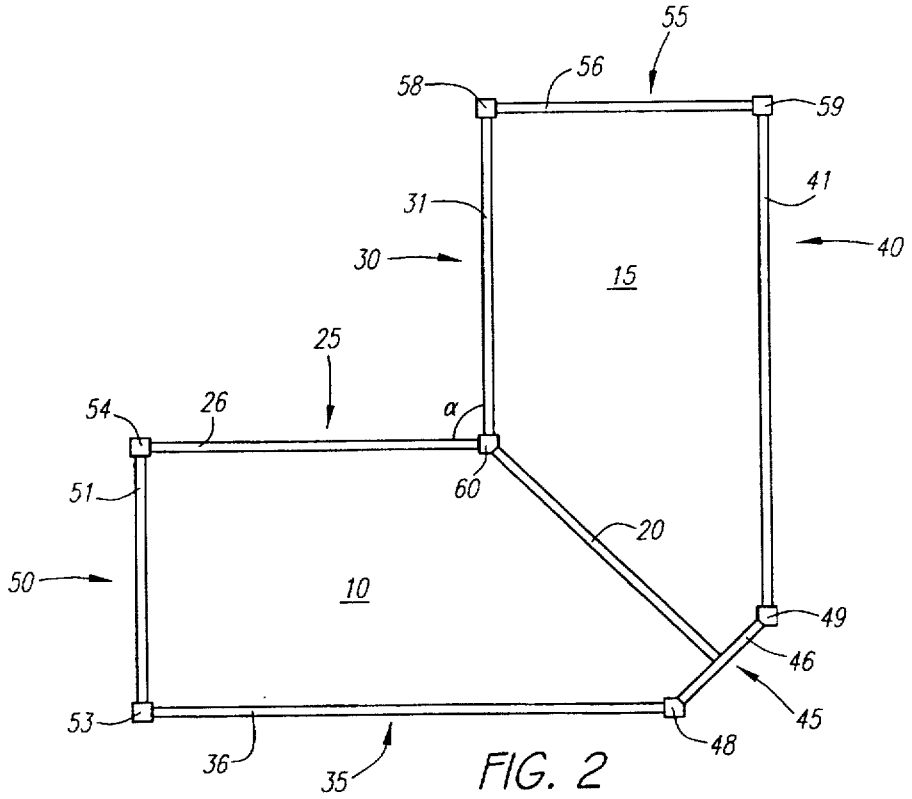
FIG. 2 is a top plan view of the twin crib in FIG. 1.

The drawings illustrate two embodiments of the present invention. Turning to FIG. 1 and FIG. 2, a first embodiment, the twin crib, is shown. FIG. 1 shows the twin crib assembled, and FIG. 2 shows a corresponding top plan view. The twin crib has a first sleeping area 10 and a second sleeping area 15 separated by a divider 20.

A first front panel 25 comprises a horizontal top rail 26, a horizontal bottom rail 27, and a plurality of vertical safety bars 200 dispersed therebetween. A second front panel 30 also comprises a horizontal top rail 31, a horizontal bottom rail 32, and a plurality of vertical safety bars 200 dispersed therebetween. The first front panel 25 intersects the second front panel 30 at an angle $\alpha$ which is less than one-hundred and eighty degrees. Preferably, $\alpha$ equals ninety degrees, but this is not required.

A first back panel 35 is located behind the first front panel 25, and comprises a horizontal top rail 36, a horizontal bottom rail 37, and a plurality of vertical safety bars 200 dispersed therebetween. Similarly, a second back panel 40 is located behind the second front panel 30, and comprises a horizontal top rail 41, a horizontal bottom rail 42, and a plurality of vertical safety bars 200 dispersed therebetween. The first back panel 35 and the second back panel 40 are positioned at an angle of preferably ninety degrees to each other. However, the back panels 35 and 40 do not intersect. Instead, a center support panel 45 positioned behind the intersection of the first and second front panels 25 and 30 forms a connecting bridge between the first and second back panels 35 and 40.

The center support panel 45 comprises a horizontal top rail 46, a horizontal bottom rail 47, a plurality of vertical safety bars 200 dispersed therebetween, and legs 48 and 49 which extend vertically downward from its top rail 46 down to a predetermined distance D past its bottom rail 47. The leg 48 of the center support panel 45 is connected to the top rail 36 and to the bottom rail 37 of the first back panel 35, and the other leg 49 of the center support panel 45 is connected to the top rail 41 and to the bottom rail 42 of the second back panel 40.

A first side support panel 50 comprises a horizontal top rail 51, a horizontal bottom rail 52, a plurality of vertical safety bars 200 dispersed therebetween, and legs 53 and 54 which extend vertically downward from its top rail 51 down to the predetermined distance D past its bottom rail 52. The leg 54 of the first side support panel 50 is connected to the top rail 26 and to the bottom rail 27 of the first front panel 25, and the other leg 53 of the first side support panel 50 is connected to the top rail 36 and to the bottom rail 37 of the first back panel 35.

A second side support panel 55 comprises a horizontal top rail 56, a horizontal bottom rail 57 (FIG. 3), a plurality of vertical safety bars 200 dispersed therebetween, and legs 58 and 59 which extend vertically downward from its top rail 56 down to the predetermined distance D past its bottom rail 57. The leg 58 of the second side support panel 55 is connected to the top rail 31 and to the bottom rail 32 of the second front panel 30, and the other leg 59 of the second side support panel 55 is connected to the top rail 41 and to the bottom rail 42 of the second back panel 40.

A vertical post 60 is connected to the top rail 26 and to the bottom rail 27 of the first front panel 25, and to the top rail 31 and to the bottom rail 32 of the second front panel 30, where the two front panels 25 and 30 would otherwise intersect in front of the center support panel 45. The divider 20 is preferably fixedly connected to the post 60 and to the center support panel 45, but may be detachably connected using conventional means.

Once the components of the twin crib are assembled together as herein described, the first front panel 25, the post 60, the second front panel 30, the second side support panel 55, the second back panel 40, the center support panel 45, the first back panel 35, and the first side support panel 50 define the edges of a closed geometric figure which represent the outer boundaries of the twin crib. This is best seen in FIG. 2.

All of the components of the twin crib are connected together as described using conventional techniques. The back panels 35 and 40 are fixedly mounted. The front panels 25 and 30, on the other hand, are slidably mounted for vertical movement in a conventional manner, independent of each other. The first front panel 25 may rest in one of two positions, the first being where its top rail 26 is at a height approximately equal to the height of the top rail 36 of the first back panel 35, and the second being where its top rail 26 is at a height at least several inches lower than at the first position. Similarly, the second front panel 30 may do the same. Sliding bracket hardware (not shown) is mounted in appropriate locations on the post 60, on the legs 54 and 58 of the first side support panel 50 and second side support panel 55 respectively, and on the top rails 26 and 31 and bottom rails 27 and 32 of the first and second front panels 25 and 30 respectively. Such hardware is well-known in the art. The purpose of slidably mounting the front panels 25 and 30 is to allow the caretaker to position the front panels 25 and 30 each at one of two positions as needed. For example, the first front panel 25 may be lowered to access an infant in the first sleeping area 10, while the second front panel 30 may be left at its highest position to prevent another infant in the second sleeping area 15 from falling out of the crib. The divider 20 is connected to the center support panel 45 by conventional means such as screws. The connection to the post 60 may also be by any conventional means, but preferably is achieved by inserting a vertical portion of the frame of the divider 20 into a corresponding groove in the post 60.

Figure 3:
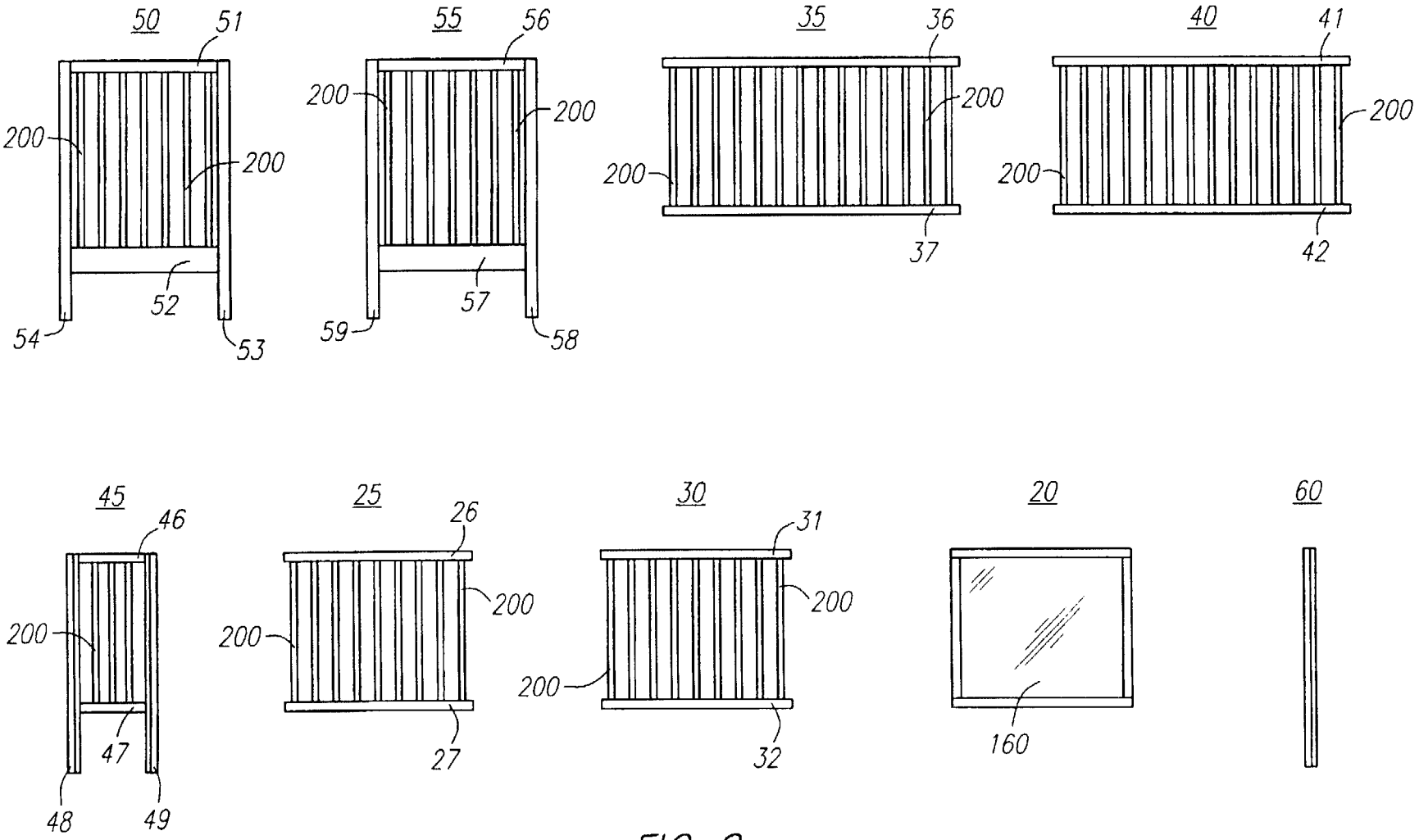
FIG. 3 shows individual components of the twin crib prior to being assembled together.

Turning briefly now to FIG. 3, individual components of the twin crib are shown prior to being assembled together to form the twin crib. As is best seen in FIG. 3, the first front panel 25 and the second front panel 30 are preferably identical to each other; the first side support panel 50 and the second side support panel 55 are preferably identical to each other; and the first back panel 35 and the second back panel 40 are preferably identical to each other.

Figure 4:
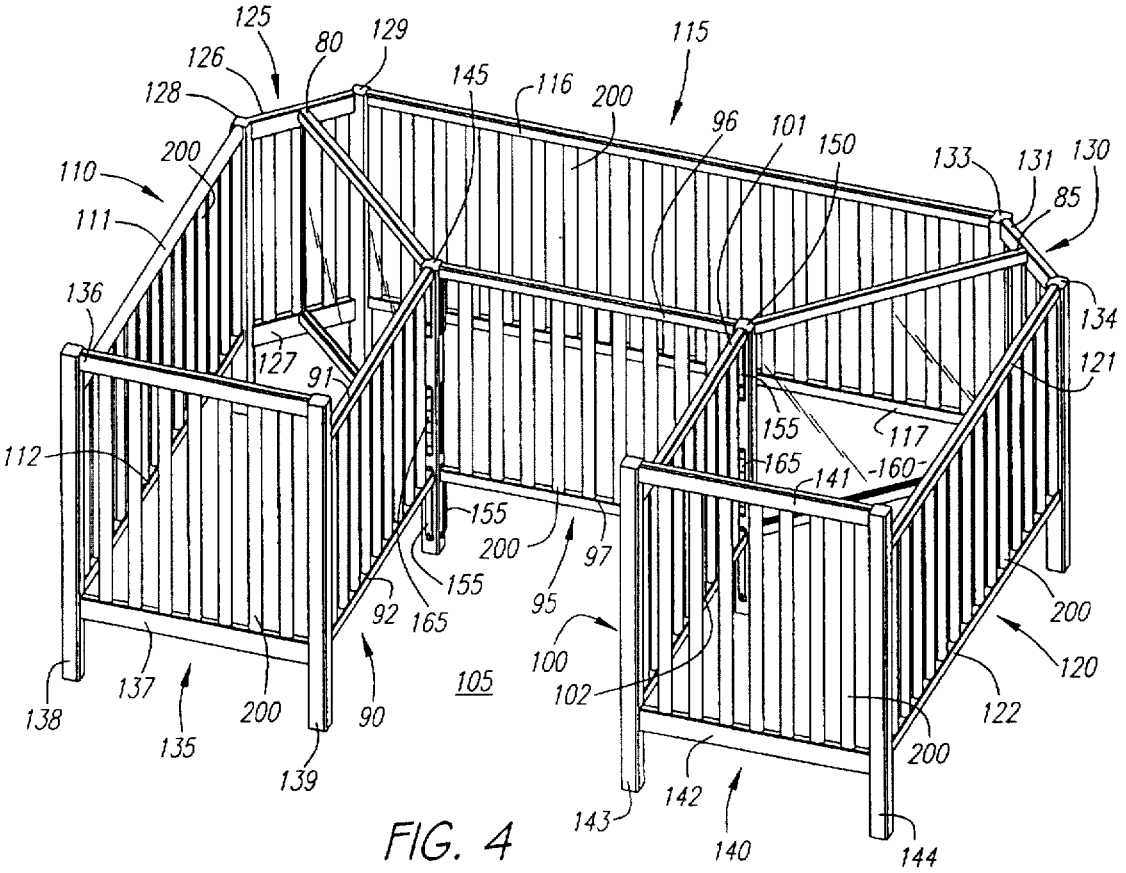
FIG. 4 is a perspective view from the front of the triplet crib of the present invention.
Figure 5:
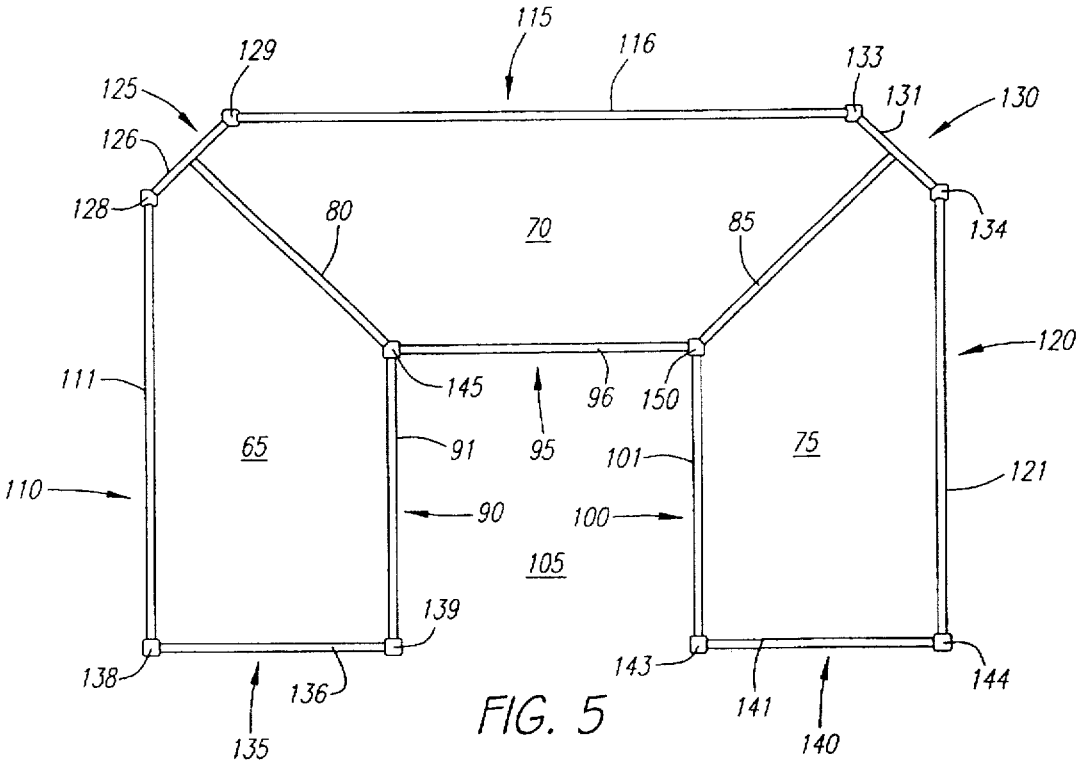
FIG. 5 is a top plan view of the triplet crib in FIG. 4.

Turning now to FIG. 4 and FIG. 5, a second embodiment, the triplet crib, is shown. FIG. 4 shows the triplet crib assembled, and FIG. 5 shows a corresponding top plan view. The triplet crib has a first sleeping area 65, a second sleeping area 70, and a third sleeping area 75. The first sleeping area 65 is separated from the second sleeping area 70 by a first divider 80, and the second sleeping area 70 is separated from the third sleeping area 75 by a second divider 85.

First, second, and third front panels 90, 95, and 100, of the sleeping areas 65, 70, and 75, respectively, intersect to form three sides of a geometric figure, preferably a square, where the first front panel 90 and the third front panel 100 form opposite sides of the figure. The fourth side of the figure remains open, and the inside of the figure serves as a standing area 105 outside of the triplet crib where the caretaker has access to all three front panels 90, 95, and 100.

The first front panel 90 comprises a horizontal top rail 91, a horizontal bottom rail 92, and a plurality of vertical safety bars 200 dispersed therebetween. The second front panel 95 also comprises a horizontal top rail 96, a horizontal bottom rail 97, and a plurality of vertical safety bars 200 dispersed therebetween. Similarly, the third front panel 100 comprises a horizontal top rail 101, a horizontal bottom rail 102, and a plurality of vertical safety bars 200 dispersed therebetween.

A first back panel 110 is located behind the first front panel 90, and comprises a horizontal top rail 111, a horizontal bottom rail 112, and a plurality of vertical safety bars 200 dispersed therebetween. Similarly, a second back panel 115 is located behind the second front panel 95, and comprises a horizontal top rail 116, a horizontal bottom rail 117, and a plurality of vertical safety bars 200 dispersed therebetween. And a third back panel 120 is located behind the third front panel 100, and comprises a horizontal top rail 121, a horizontal bottom rail 122, and a plurality of vertical safety bars 200 dispersed therebetween. The first back panel 110 and the third back panel 120 are preferably parallel to each other, and positioned at an angle of ninety degrees to the second back panel 115. However, neither the first back panel 110 nor the third back panel 120 intersect the second back panel 115. Instead, a first center support panel 125 positioned behind the intersection of the first and second front panels 90 and 95 forms a connecting bridge between the first back panel 110 and the second back panel 115. Similarly, a second center support panel 130 positioned behind the intersection of the second and third front panels 95 and 100 forms a connecting bridge between the second back panel 115 and the third back panel 120.

The first center support panel 125 comprises a horizontal top rail 126, a horizontal bottom rail 127, a plurality of vertical safety bars 200 dispersed therebetween, and legs 128 and 129 which extend vertically downward from its top rail 126 down to a predetermined distance D past its bottom rail 127. The leg 128 of the first center support panel 125 is connected to the top rail 111 and to the bottom rail 112 of the first back panel 110, and the other leg 129 of the first center support panel 125 is connected to the top rail 116 and to the bottom rail 117 of the second back panel 115.

Likewise, the second center support panel 130 comprises a horizontal top rail 131, a horizontal bottom rail 132 (FIG. 6), a plurality of vertical safety bars 200 dispersed therebetween, and legs 133 and 134 which extend vertically downward from its top rail 131 down to the predetermined distance D past its bottom rail 132. The leg 133 of the second center support panel 130 is connected to the top rail 116 and to the bottom rail 117 of the second back panel 115, and the other leg 134 of the second center support panel 130 is connected to the top rail 121 and to the bottom rail 122 of the third back panel 120.

A first side support panel 135 comprises a horizontal top rail 136, a horizontal bottom rail 137, a plurality of vertical safety bars 200 dispersed therebetween, and legs 138 and 139 which extend vertically downward from its top rail 136 down to the predetermined distance D past its bottom rail 137. The leg 138 of the first side support panel 135 is connected to the top rail 111 and to the bottom rail 112 of the first back panel 110, and the other leg 139 of the first side support panel 135 is connected to the top rail 91 and to the bottom rail 92 of the first front panel 90.

A second side support panel 140 comprises a horizontal top rail 141, a horizontal bottom rail 142, a plurality of vertical safety bars 200 dispersed therebetween, and legs 143 and 144 which extend vertically downward from its top rail 141 down to the predetermined distance D past its bottom rail 142. The leg 143 of the second side support panel 140 is connected to the top rail 101 and to the bottom rail 102 of the third front panel 100, and the other leg 144 of the second side support panel 140 is connected to the top rail 121 and to the bottom rail 122 of the third back panel 120.

A first vertical post 145 is connected to the top rail 91 and to the bottom rail 92 of the first front panel 90, and to the top rail 96 and to the bottom rail 97 of the second front panel 95, where the first front panel 90 and the second front panel 95 would otherwise intersect in front of the first center support panel 125. A second vertical post 150 is connected to the top rail 96 and to the bottom rail 97 of the second front panel 95, and to the top rail 101 and to the bottom rail 102 of the third front panel 100, where the second front panel 95 and the third front panel 100 would otherwise intersect in front of the second center support panel 130.

The first divider 80 is preferably fixedly connected to the first post 145 and to the first center support panel 125, but may be detachably connected using conventional means. Similarly, the second divider 85 is preferably fixedly connected to the second post 150 and to the second center support panel 130, but may be detachably connected using conventional means.

Once the components of the triplet crib are assembled together as herein described, the first front panel 90, the first post 145, the second front panel 95, the second post 150, the third front panel 100, the second side support panel 140, the third back panel 120, the second center support panel 130, the second back panel 115, the first center support panel 125, the first back panel 110, and the first side support panel 135 define the edges of a closed geometric figure which represents the outer boundaries of the triplet crib. This is best seen in FIG. 5.

All of the components of the triplet crib are connected together as described using conventional techniques. The back panels 110, 115, and 120 are fixedly mounted. The front panels 90, 95, and 100, on the other hand, are slidably mounted for vertical movement in a conventional manner, independent of each other. The first front panel 90 may rest in one of two positions, the first being where its top rail 91 is at a height approximately equal to the height of the top rail 111 of the first back panel 110, and the second being where its top rail 91 is at a height at least several inches lower than at the first position. Similarly, the second front panel 95 and the third front panel 100 may do the same. Sliding bracket hardware 155 (FIG. 4) is mounted in appropriate locations on the posts 145 and 150, on the legs 139 and 143 of the first side support panel 135 and the second side support panel 140 respectively, and on the top rails 91, 96, and 101 and bottom rails 92, 97, and 102 of the first, second, and third front panels 90, 95, and 100 respectively. Such hardware is well-known in the art. The purpose of slidably mounting the front panels 90, 95, and 100 is to allow the caretaker to position the front panels 90, 95, and 100 each at one of two positions as needed. For example, the first front panel 90 may be lowered to access an infant in the first sleeping area 65, while the second and third front panels 95 and 100 may be left at their highest position to prevent other infants in the second sleeping area 70 and in the third sleeping area 75 respectively from falling out of the crib. The first and second dividers 80 and 85 are connected to the first and second center support panels 125 and 130 respectively by conventional means such as screws. The connections to the posts 145 and 150 may also be by any conventional means, but preferably are achieved by inserting a vertical portion of the frames of the first and second dividers 80 and 85 into corresponding grooves in the posts 145 and 150.

Figure 6:
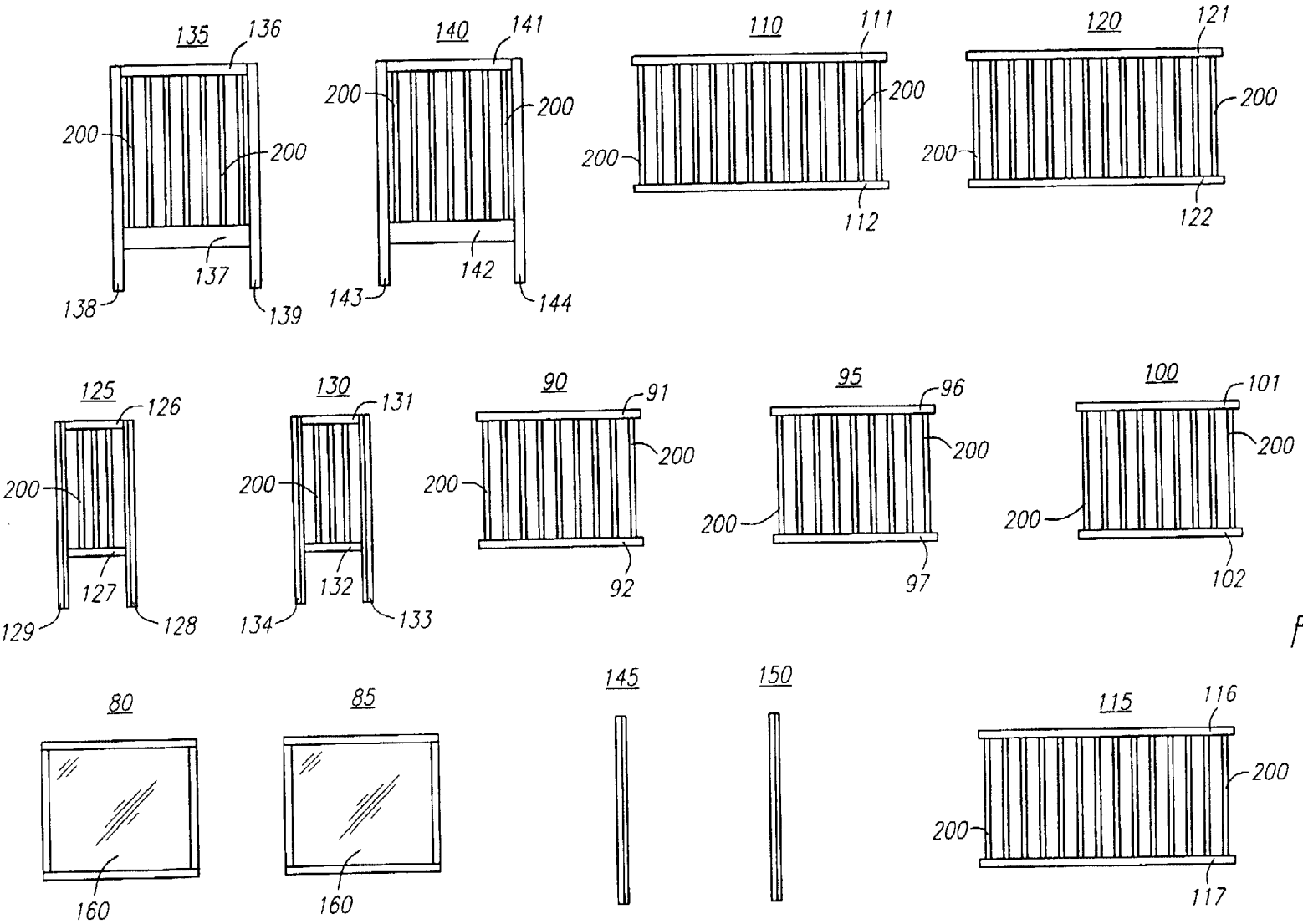
FIG. 6 shows individual components of the triplet crib prior to being assembled together.

Turning briefly now to FIG. 6, individual components of the triplet crib are shown prior to being assembled together to form the triplet crib. As is best seen in FIG. 6, the first front panel 90, the second front panel 95, and the third front panel 100 are preferably identical to each other; the first back panel 110 and the third back panel 120 are preferably identical to each other; the first center support panel 125 and the second center support panel 130 are preferably identical to each other; the first divider 80 and the second divider 85 are preferably identical to each other; the first side support panel 135 and the second side support panel 140 are preferably identical to each other; and the first post 145 and the second post 150 are preferably identical to each other. The second back panel 115 is preferably longer than the first and third back panels 110 and 120.

For both the twin crib and the triplet crib embodiments of the present invention, plastic teething rails (not shown) well-known in the art are wrapped around and secured to the top rails of the front panels. Also for both the twin crib and the triplet crib embodiments, bottoms (not shown) are adapted to be secured to the legs of the panels using conventional hardware 165 to support mattresses (not shown). The bottoms fit within the sleeping areas 10 and 15 for the twin crib, or 65, 70, and 75 for the triplet crib, and the hardware 165 allows the bottoms to be adjusted to at least three different heights. Also for both the twin crib and the triplet crib embodiments of the present invention, the panels 25, 20, 35, 40, 45, 50, 55, 90, 95, 100, 110, 115, 120, 125, 130, 135, and 140, and the posts 60, 145, and 150 are preferably made of wood such as solid oak. Furthermore, the number of safety bars 200 dispersed between the top and bottom rails of each of the panels is predetermined, though not necessarily identical. The safety bars 200 within each panel are spaced close enough to each other so the infant's head cannot wedge in between them, but far enough apart from each other for the infant to see outside. Preferably, the safety bars 200 are spaced apart uniformly within each panel, but this is not required.

In addition, the divider 20 in the twin crib should allow an infant in the first sleeping area 10 to see into the second sleeping area 15, and vice versa. Similarly, the first divider 80 in the triplet crib should allow an infant in the first sleeping area 65 to see into the second sleeping area 70, and vice versa, and the second divider 85 in the triplet crib should allow an infant in the second sleeping area 70 to see into the third sleeping area 75, and vice versa. Preferably, the dividers 20, 80, and 85 have plexiglass panes 160 framed by wood to match the wood panels. But the dividers 20, 80, and 85 may be netting or other suitable material that allows the infants to see each other.

While preferred embodiments are illustrated in the drawings and have just been described herein, it will be apparent to those skilled in the art that many modifications can be made to the preferred embodiments without departing from the inventive concepts described. Accordingly, the invention is not to be restricted except by the claims which follow.

What is claimed is:

1. A crib for two infant comprising:

a first front panel;

a second front panel connected to the first front panel and forming an angle of less than one-hundred and eighty degrees therewith;

a first back panel located behind the first front panel;

a second back panel located behind the second front panel and positioned at an angle of approximately ninety degrees to the first back panel;

a center support panel positioned behind the first and second front panels, positioned between and connected to the first back panel and the second back panel;

a first side support panel positioned between and connected to the first front panel and the first back panel; and a second side support panel positioned between and connected to the second front panel and the second back panel.

2. The crib as in claim 1 further comprising a divider which separates the crib into a first sleeping area and a second sleeping area.

3. The crib as in claim 2 wherein at least one of the first and second front panels is adjustable to various heights.

4. The crib as in claim 2 wherein the divider is adapted to prevent an infant in the first sleeping area from entering the second sleeping area, and to prevent an infant in the second sleeping area from entering the first sleeping area.

5. The crib as in claim 4 where in the divider is further adapted to allow an infant in the first sleeping area to see into the second sleeping area, and to allow an infant in the second sleeping area to see into the first sleeping area.

6. The crib as in claim 1 wherein the first front panel is connected to the second front panel by a post.

7. The crib as in claim 6 further comprising a divider which separates the crib into a first sleeping area and a second sleeping area.

8. The crib as in claim 7 wherein the divider is connected at one end to the post and at the other end to the center support panel.

9. The crib as in claim 7 wherein the divider is adapted to prevent an infant in the first sleeping area from entering the second sleeping area, and to prevent an infant in the second sleeping area from entering the first sleeping area.

10. The crib as in claim 9 wherein the divider is further adapted to allow an infant in the first sleeping area to see into the second sleeping area, and to allow an infant in the second sleeping area to see into the first sleeping area.

11. A crib for two infants comprising:

a first sleeping area with a longitudinal axis;

a second sleeping area with a longitudinal axis;

a divider which separates the first and second sleeping areas, and which allows an infant in the first sleeping area to see into the second sleeping area and an infant in the second sleeping area to see into the first sleeping area;

the longitudinal axis of the first sleeping area intersecting the longitudinal axis of the second sleeping area at substantially a right angle.

12. The crib as in claim 11 further comprising a first back panel positioned in back of the first sleeping area substantially parallel to the longitudinal axis thereof, and a second back panel positioned behind the second sleeping area substantially parallel to the longitudinal axis thereof.

13. The crib as in claim 12 further comprising a center support panel positioned between and connected to the first back panel and the second back panel.

14. The crib as in claim 11 wherein the divider is adapted to prevent an infant in the first sleeping area from entering the second sleeping area, and to prevent an infant in the second sleeping area from entering the first sleeping area.

15. A crib for three infants comprising:

a first front panel;

a second front panel;

a third front panel;

the first front panel being connected to the second front panel at an angle of less than one-hundred and eighty degrees, and the second front panel being connected to the third front panel at an angle of less than one-hundred and eighty degrees, the three front panels forming three sides of a geometric figure;

a first back panel located behind the first front panel;

a second back panel located behind the second front panel;

a third back panel located behind the third front panel;

a first center support panel located between and connecting the first back panel and the second back panel;

a second center support panel located between and connecting the second back panel and the third back panel;

a first side support panel located between and connecting the first front panel and the first back panel; and a second side support panel located between and connecting the third front panel and the third back panel.

16. The crib as in claim 15 further comprising a first divider positioned inside the crib wherein the first divider forms a side of a first sleeping area defined at least substantially by the first front panel, the first side support panel, the first back panel, and the first divider.

17. The crib as in claim 16 further comprising a second divider positioned inside the crib wherein the second divider forms a side of a second sleeping area defined at least substantially by the second front panel, the first divider, the second back panel, and the second divider, and wherein the second divider also forms a side of a third sleeping area defined at least substantially by the third front panel, the third side support panel, the third back panel, and the second divider.

18. The crib as in claim 15 wherein the first front panel is connected to the second front panel by a first post, and wherein the second front panel is connected to the third front panel by a second post.

19. The crib as in claim 18 further comprising a first divider positioned inside the crib wherein the first divider forms a side of a first sleeping area defined at least substantially by the first front panel, the first side support panel, the first back panel, and the first divider.

20. The crib as in claim 19 further comprising a second divider positioned inside the crib wherein the second divider forms a side of a second sleeping area defined at least substantially by the second front panel, the first divider, the second back panel, and the second divider, and wherein the second divider also forms a side of a third sleeping area defined at least substantially by the third front panel, the third side support panel, the third back panel, and the second divider.

21. The crib as in claim 17 wherein the first divider is adapted to prevent an infant in the first sleeping area from entering the second sleeping area, and to prevent an infant in the second sleeping area from entering the first sleeping area, and wherein the second divider is adapted to prevent an infant in the second sleeping area from entering the first or the third sleeping areas, and to prevent an infant in the first or the third sleeping areas from entering the second sleeping area.

22. The crib as in claim 21 wherein the first divider is further adapted to allow an infant in the first sleeping area to see into the second sleeping area, and to allow an infant in the second sleeping area to see into the first sleeping area, and wherein the second divider is further adapted to allow an infant in the second sleeping area to see into the third sleeping area, and to allow an infant in the third sleeping area to see into the second sleeping area.

23. A crib for more than one infant comprising:

a plurality of panels connected together to form the outer boundaries of the crib;

a plurality of legs connected to at least one of the plurality of panels for supporting the crib; and a predetermined number n of dividers wherein n is at least one and wherein the n dividers separate the crib into n+1 sleeping areas each having a longitudinal axis;

wherein the n+1 sleeping areas comprise a first sleeping area, and a second sleeping area adjacent to the first sleeping area, and wherein the longitudinal axis of the first sleeping area intersects the longitudinal axis of the second sleeping area at substantially a right angle.

24. The crib as in claim 23 wherein one of the n dividers is adapted to allow an infant in the first sleeping area to see into the second sleeping area, and to prevent the infant in the first sleeping area from entering the second sleeping area.

25. The crib as in claim 20 wherein the number n of dividers is 1.

26. The crib as in claim 23 wherein the number n of dividers is 2, whereby the crib further comprises a third sleeping area.

27. The crib as in claim 26 wherein the longitudinal axis of the third sleeping area intersects the longitudinal axis of the second sleeping area at substantially a right angle.

* * * * *